US007926307B1

(12) United States Patent
Williams

(10) Patent No.: US 7,926,307 B1
(45) Date of Patent: Apr. 19, 2011

(54) DOUBLE SIDED POLYPROPYLENE KNIT LOOP FABRIC

(76) Inventor: John M. Williams, Tullahoma, TN (US)

( * ) Notice: Subject to any disclaimer, the term of this patent is extended or adjusted under 35 U.S.C. 154(b) by 743 days.

(21) Appl. No.: 11/416,343

(22) Filed: May 2, 2006

(51) Int. Cl.
*D04B 7/12* (2006.01)

(52) U.S. Cl. ..... 66/194; 66/202

(58) Field of Classification Search ..... 66/202, 66/191, 194; 442/304
See application file for complete search history.

(56) References Cited

U.S. PATENT DOCUMENTS 2,893,226 A 7/1959 Lombardi
3,021,698 A 2/1962 Hill
3,977,216 A 8/1976 Lombardi et al.
4,712,281 A * 12/1987 Scheller ..... 28/162
4,785,558 A 11/1988 Shiomura
5,385,036 A 1/1995 Spillane et al.
5,508,098 A 4/1996 Omar et al.
5,651,847 A 7/1997 Loeffler
5,855,125 A * 1/1999 Lohmueller et al. ..... 66/196
5,896,758 A 4/1999 Rock et al.
6,131,419 A * 10/2000 Rock et al. ..... 66/194
6,634,190 B2 10/2003 Didier-Laurent
6,644,070 B2 11/2003 Ikenaga et al.
6,745,600 B2 * 6/2004 Weiqing et al. ..... 66/194

* cited by examiner

*Primary Examiner* — Danny Worrell
(74) *Attorney, Agent, or Firm* — Stephen J. Stark; Miller & Martin PLLC

(57) ABSTRACT

A double sided polypropylene knit loop fabric comprises at least one and preferably both of the inner and outer loops comprised of polypropylene yarn forming cantilevered loops from a knit fabric. Polypropylene has many different characteristics than those of cotton or cotton blends. Accordingly, by making at least one of the loops, if not both of the loops, and the tie yarn out at least substantially, if not principally, polypropylene, a fabric can be produced which has different characteristics than a cotton fabric of similar construction.

20 Claims, 1 Drawing Sheet

DOUBLE SIDED POLYPROPYLENE KNIT LOOP FABRIC

FIELD OF THE INVENTION

This application relates to a double sided polypropylene yarn knit terry fabric, and more particularly to a fabric made of three polypropylene yarns so that an inside loop yarn, an outside loop yarn and a tie yarn connect inner and outer loops together as the stitching is formed in preparation for the next course preferably in a circular knit manner.

DESCRIPTION OF RELATED ART

U.S. Pat. Nos. 2,893,226 and 3,977,216 show methods and devices for knitting double sided loops connected with a tie yarn. In the past it has been known to utilize equipment to form two sided cotton Terry cloth fabric. Cotton has a number of desirable features when utilized with clothing. One of the features of cotton is its ability to absorb moisture. Cotton Terry cloth is often used for making towels and robes where this feature is desirable. However, cotton has a thermal conductivity of 17.5 which does not make it an ideal insulative fabric material.

In order to overcome the drawbacks of cotton fabric, a competitor has developed a polyester single sided loop fleece product commonly known as Polar Tec®. Polar Tec® has been widely received throughout the fabric and garment industry as a desirable fabric material for cold weather clothing. Polyester has a thermal conductivity of 7.3.

While polypropylene yarn has been utilized to provide interconnected spaced apart webs of fabric as shown in U.S. Pat. No. 5,651,847, the applicant is unaware of any attempt to create a double sided polypropylene loop product which is believed to be suited for many applications. Furthermore, no cantilevered polypropylene loop fabric is known by the applicant to exist.

SUMMARY OF THE INVENTION

Accordingly, it is an object of the present invention to provide a double sided cantilevered loop fabric utilizing polypropylene yarns for the upper and lower loop yarns as well as the tie yarn.

In an alternatively preferred embodiment, it may be possible that two of the three yarns be polypropylene. By substituting and/or combining a cotton yarn and/or other yarn material with the polypropylene for one or more of the yarns, it may be possible to assist in wicking water away from the body of an individual wearing a fabric constructed of the fabric.

Accordingly, in the presently preferred embodiment of the present invention, a circular knitting machine forms inner and outer loops utilizing first and second yarns while utilizing a third yarn as a tie yarn to form a knit as shown in a method of construction somewhat similar to that shown in U.S. Pat. No. 3,977,216 or 2,893,226 which heretofore has only been known to have been utilized in conjunction with the formation of cotton, or cotton blended Terry fabric by the applicant.

By utilizing at least one of the three, if not two, or even all three of the three yarns as polypropylene instead of 100% cotton or at least a majority of cotton blended with some plastic other than polypropylene, the thermal conductivity of the fabric can be significantly lowered from about 17.5, the thermal conductivity of cotton, toward about 6, the thermal conductivity of polypropylene. Polypropylene has a number of characteristics which differ from cotton which may be advantageous for various applications.

BRIEF DESCRIPTION OF THE DRAWINGS

The particular features and advantages of the invention as well as other objects will become apparent from the following description taken in connection with the accompanying drawings in which.

DETAILED DESCRIPTION OF THE INVENTION

Figure 1:
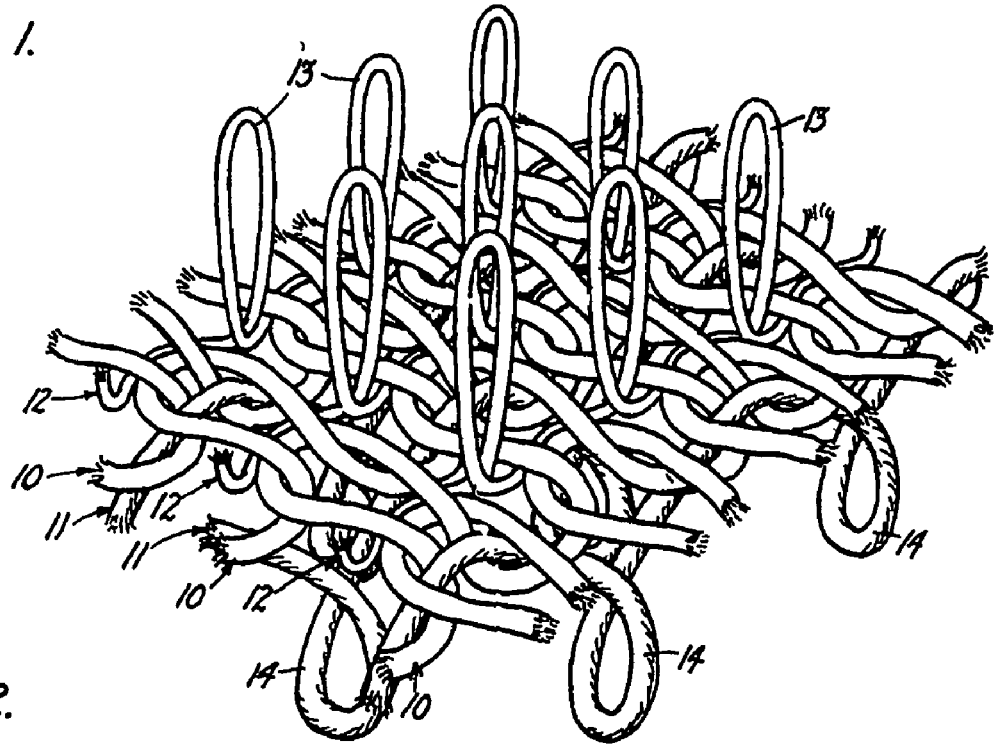
FIG. 1 is a top perspective view of a portion of fabric formed in accordance with the presently preferred embodiment of the present invention.
Figure 2:
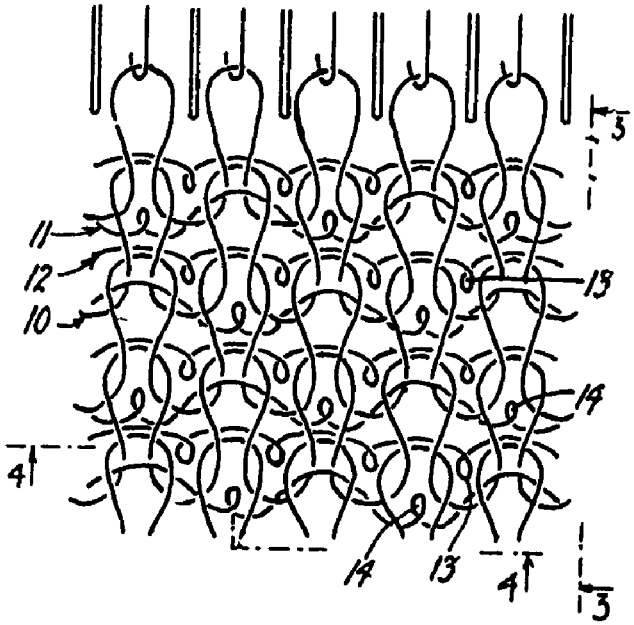
FIG. 2 is a top plan view of the fabric shown in FIG. 1.

FIGS. 1 and 2 show a double cantilevered loop fabric constructed in accordance with the presently preferred embodiment of the present invention wherein the ground or tie yarn 10, the back loop yam 11 and the front loop yarn 12 are simultaneously knitted to a base fabric of a single jersey construction. The back loop yarn 11 is introduced on top of the fabric web but on the needle latch through sinker means forming back cantilevered loops 14. Lombardi, U.S. Pat. Nos. 2,893,226 and 3,977,216 describe two methods of this type construction. Accordingly, while back loops 14 are formed below the fabric, (our technical reverse side), front cantilevered loops 13 are drawn to the technical face side of the fabric. The front loop yarn 12 is introduced below a sinker nib in a convention type of a sinker nib such as is described in the Lombardi patents.

Figure 3:
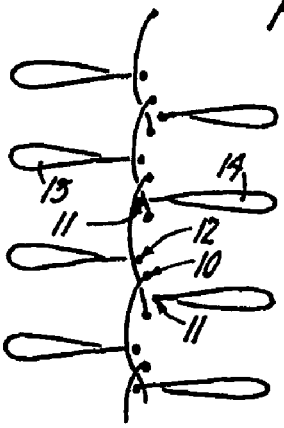
FIG. 3 is a cross sectional view taken along the line 3-3 in FIG. 2.
Figure 4:
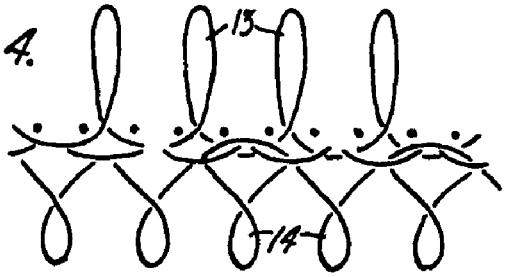
FIG. 4 is a cross sectional view taken along the line 4-4 in FIG. 2.

FIG. 2 shows a cross section of the fabric 20 showing orientation of the cantilevered loops 13,14 relative to the ground yam 10 forming the knit web. FIGS. 3 and 4 are cross sections taken along lines 3-3 and 4-4 of FIG. 2. The illustrated knitting construction is but one way of knitting loops. Other methods such as those shown in U.S. Pat. No. 3,977,216 and others could also be employed to construct a double sided loop fabric.

However, in the prior art, the yams utilized to form fabric were primarily, if not entirely, cotton yarn. No use of polypropylene in a yarn for such construction is known by the applicant. As can be seen from FIG. 1, the upper loop yarn 12, the lower loop yarn 11 as well as the tie yarn 10 would, in the prior art, be of cotton construction. However, in the presently preferred embodiment of the present invention, the three yarns, the upper loop yarn 12, the lower loop yarn 11 as well as the tie yarn 10 are preferably principally polypropylene yarns.

Polypropylene has been selected by the applicant because it has been observed that polypropylene fiber provides a greater coverage per pound than other fibers including polyester, nylon, acrylic, and cotton. Furthermore, polypropylene provides an excellent warmth to weight ratio due to polypropylene fiber being constructed of a thermoplastic material having a specific gravity less than 1.0 making it therefore lighter than water. Polypropylene yarn is also hydrophobic and will not absorb moisture. This is not true of cotton.

Having a degree of crystallinity of 72-75% has been found to provide a polypropylene fiber that is strong and resilient. Furthermore, polypropylene fibers have been found to provide a high work to rupture ratio indicating it is a relatively tough fiber therefore establishing excellent resistance to mechanical abuse. Polypropylene fibers are stain resistant and provide a color that is permanent with excellent fade resistance. Other resistances exhibited by polypropylene fiber includes resistance to most acids and alkalines, resistance to bleaches and solvents, resistance to mildew and aging, resistance to abrasion, and resistance to sunlight when UV stabilizers are utilized.

Below is a chart of thermal conductivity of various fibers:

| FIBER | THERMAL CONDUCTIVITY |
|---|---|
| Polypropylene | 6 |
| PVC | 6.4 |
| Silk | 7 |
| Polyester | 7.3 |
| Wool | 8 |
| Acrylic | 8 |
| Nylon | 10 |
| Viscose | 11 |
| Cotton | 17.5 |

As can be seen from the table above, thermal conductivity of polypropylene is significantly lower than that of cotton and therefore, thereby providing better insulative effects.

When knitting the fabric, the three yarns 10,11,12 are introduced into each needle and sinker in each course or stitch formation. The tie yarn 10 is so called for its formation is to tie together the other two yarns, the inside loop yarn and the outside loop yarns 11,12. The yarn carrier, a device to guide the three different yarns from different position into the needle and sinker at relative spacing elevation with relation to the needle position and sinker position as set by the design of the cam for the needle box and sinker box is utilized. Each yarn is specifically placed in the yarn carrier to make a relative formation in the fabric design.

The inside loop yarn 11 forms across the nose of the sinker while the outside loop yarn 12 is guided into a special slot in the top of the sinker so as the sinker moves in and out these yarns 11 are wrapped by the tie yarn 10 which locks them all together as the stitches form in preparation for the next course. With this ability of the three yarns, it is possible to realize different sizes, colors and fiber content with any combination relation to the fabric system. The fabrics that can be designed from this technology are very special in their abilities to provide thermal properties, moisture control and other properties directly benefiting from the inherent ability of the polypropylene fibers utilized therewith. At least one of the three yarns 10,11,12 is polypropylene, preferably 100% polypropylene.

In fact, at least one of the loop yarns 11 or 12 is polypropylene. No loop knit cloth is known by the applicant to have polypropylene loops. When polypropylene is utilized to form loop preferably solution dyed fibers medium to high tenacity is achieved. Additives such as antimicrobial protections with efficacy from 50-100 washings can protect the fabric from discoloration and odor caused by bacteria. The loops are hydrophobic, exhibit high UV resistance, 1,000-2,500 hours in some instances, and can be photochromic to cause fibers to change color when exposed to sunlight in some embodiments. Thermochromic fibers can be utilized which cause fiber to change color when exposed to minor elevated temperatures in some embodiments. Fluorescence fibers also can be utilized to allow at least some fibers to glow in the dark in some applications.

The yarn type may be continuous filament or spun fibers. When utilizing a continuous filament, the yarn size is preferably 120-160 denier and when utilizing a spun yarn, the size is preferably 40/1 cc-26/1 cc. Yarn filament counts can range from 40-90 filaments. The polyester tie yarn is preferably yarn 50 denier to 90 denier and comprises 8-10% of the finished fabric 20, while the polypropylene loop yarn 11,12 of both sides is 120-160 denier and comprises 90-92% of the completed fabric. The loop height is preferably 2.1 mm to 3.4 mm on each side. A thickness of 0.12 inches minimum has been achieved. A yield can range from 6.0-13.0 oz. per square yard with a machine cut of 18-24. The machine cylinder size is preferably 20 to 30 inches.

After knitting a circular knitted Greige good having inner and outer loops as shown in FIGS. 1 and 2, the fabric is preferably lightly scoured to adjust the pH level. A lubricant can then be added to aid in the napping process. Since the fabric is preferably knitted as a circular knit Greige good, it can be slit to open up the width. For example, if the circular knit goods is 35 inches, the open width would be approximately 70 inches prior to finishing. After slitting, the fabric can be dried to a damp state.

The next step may be to nap the first side of the fabric. The napping process is used to bring up a fuzz, nap resembling a long velour effect. This may be accomplished by the napping process and affects the height of the knitted loop. Once the first side is napped, the opposite or second side can be napped utilizing the same process. At this point, a double-sided fuzz or napped fabric has been provided. Shearing on one or both sides can reduce the height and hairiness of the nap. Some fabrics are sheared the same on both sides, others depending on application may be sheared more or less on one side than the other.

After both sides have been sheared to the correct pile height, the fabric may be exposed to a final framing where an amount of heat is added so that the fabric is not burned or melted. The fabric may also be stretched in the machine direction and cross machine direction to adjust shrinkage length versus width and to set other physical properties such as fabric weight, wales per inch/course pr inch, and fabric breaking strength.

At this point, the fabric is allowed to dry for 24 hours and then bagged in polyethylene bags for transport.

By constructing the preferred embodiment out of polypropylene yarns, different mechanical characteristics are experienced than with cotton or even cotton blends, of prior art yarns.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A fabric comprising:

a first loop yarn comprised of polypropylene;

a second loop yarn; and a tie yarn;

wherein said first loop yarn forms a plurality of cantileveredly extending first loops from a first face of a fabric formed with the tie yarn, and the second loop yarn forms a plurality of cantileveredly extending second loops from a second face of the fabric, said first face of the fabric opposite the second face.

2. The fabric of claim 1 wherein the fabric has a thermal conductivity less than about 10.

3. The fabric of claim 2 wherein the fabric has a thermal conductivity less than seven.

4. The fabric of claim 1 wherein the first loops are at least one of napped and sheared.

5. The fabric of claim 1 wherein the second loop yarn is comprised of polypropylene.

6. The fabric of claim 5 wherein the second loops are at least one of napped and sheared.

7. The fabric of claim 1 wherein the tie yarn is comprised of polypropylene.

8. The fabric of claim 7 wherein the second loop yarn is comprised of polypropylene.

9. The fabric of claim 1 wherein the first loops are hydrophobic.

10. The fabric of claim 1 wherein the fabric is hydrophobic.

11. The fabric of claim 1 wherein the fabric is at least one of photochromic, thermocromic and fluorescent.

12. The fabric of claim 1 further comprising an antimicrobial protection having an efficacy of at least 50 washings.

13. The fabric of claim 1 having a UV resistance of at least one thousand hours.

14. The fabric of claim 1 formed by the process of circular knitting.

15. The fabric of claim 14 wherein after knitting, the fabric is slit.

16. The fabric of claim 15 wherein after slitting the fabric, at least one side is napped to provide a napped side.

17. The fabric of claim 1 wherein the first loop yarn is introduced from the second face of the fabric and drawing out the loops from the first face, and the second loop yarn is introduced from the first face and drawing out the loops from the second face.

18. The fabric of claim 1 wherein at least one of the first loop yarn, the second loop yarn and the tie yarn are at least substantially polypropylene.

19. The fabric of claim 1 wherein at least one of the first loop yarn, the second loop yarn and the tie yarn are at least substantially polypropylene.

20. The fabric of claim 19 wherein the first loop yarn, the second loop yarn and the tie yarn are primarily polypropylene.

* * * * *